United States Patent [19]

Prendergast

[11] Patent Number: 4,710,299

[45] Date of Patent: Dec. 1, 1987

[54] CYCLONE SEPARATOR

[75] Inventor: Gavan J. J. Prendergast, Glen Iris, Australia

[73] Assignee: Noel Carroll, Sherbrooke, Australia

[21] Appl. No.: 848,385

[22] Filed: Apr. 4, 1986

Related U.S. Application Data

[63] Continuation-in-part of Ser. No. 776,164, filed as PCT AU85/0001, Jan. 24, 1985, published as WO85/03242, Aug. 1, 1985, abandoned.

[30] Foreign Application Priority Data

Jan. 24, 1984 [AU] Australia ..... PG3311/84
Jan. 24, 1985 [CA] Canada ..... 472531
Apr. 4, 1985 [AU] Australia ..... 40909/85

[51] Int. Cl.[4] ..... B04C 5/081

[52] U.S. Cl. ..... 210/512.1; 209/144; 209/211

[58] Field of Search ..... 210/788, 512.1, 322; 209/211, 144; 55/447

[56] References Cited

U.S. PATENT DOCUMENTS 4,237,006 12/1980 Coleman et al. ..... 210/512.1
4,464,264 8/1984 Carroll ..... 210/512.1
4,544,486 10/1985 Carroll ..... 210/512.1

*Primary Examiner*—Frank Sever
*Attorney, Agent, or Firm*—Ladas & Parry

[57] ABSTRACT

A cyclone separator having an inlet with inner and outer profiles, viewed in section transverse to the separator axis. This location of any particular point on the outer profile is defined by a vector contained in a plane normal to the separator axis, and having its origin at a location (C) where the outer profile meets the adjacent inner circumference of the separator. As the magnitude of the vector (T) increases, an angle ($\theta$) between the vector (T) and a tangent to the circumference (C) which passes through location (C) never decreases and never becomes less than negative 0.1 radian. The location of any particular point on the inner profile is defined by a vector (U) having its point of origin at a location (E) where the inner profile or at least its projection meets the separator circumference. As the magnitude of vector (U) increases, an angle ($\zeta$) between vector (U) and a tangent to circumference which passes through location (E) never decreases and never becomes less than negative 0.52 radian, at least for substantial magnitudes of vector (U).

25 Claims, 8 Drawing Figures

CYCLONE SEPARATOR

This is a continuation-in-part of co-pending U.S. application Ser. No. 776,164, filed Sept. 4, 1985, now abandoned.

This invention relates to a cyclone separator for separating denser components of a fluid mixture from less dense components thereof, said separator being of a kind having an axially extending separating chamber having towards one end inlet means for admission of the mixture with a tangential flow component, the separating chamber having an axially positioned overflow outlet adjacent said one end and said separating chamber of generally tapered form with a relatively larger cross-sectional size at said one end and a relatively small cross-sectional size at an axially positioned underflow outlet at the end of the separating chamber opposite said one end, wherein in use the denser component is directed to the underflow outlet in a fashion such as to encompass an inner axially positioned core of the less dense component which is subjected at least over a substantial part of its length to a pressure differential causing it to flow to the overflow outlet.

In accordance with one aspect of this invention, a cyclone separator as above described is characterized in that said inlet means is defined by a portion of the separating chamber and at least one inlet tract communicating with said portion, said portion being that portion of the separating chamber which is at the same lengthwise position as the or each inlet tract, and the or each said tract being of a profiled configuration. A particular form of profile in accordance with the invention is substantially involute form arranged to admit the fluid in a spiral path.

In another form the or each inlet tract presents inner and outer profiles, when viewed axially of the separator. The outer profile extends from a first location at which it meets the circumference of the aforementioned portion of the separating chamber. At least the inward projection of said inner profile extending from a second location at which the inner profile or its said projection meets said circumference, the outer profile being characterised in that a first vector T describing the location of any particular point on said outer profile and contained in a plane normal to said axis, and having its origin at said first location, is such that as the magnitude of the vector T increases, an angle $\theta$ between the vector T and that tangent to said circumference which passes through said first location never decreases substantially and never becomes less than negative 0.1 radian; the cross-sectional area perpendicular to the flow direction contracts in the direction of flow.

It has been found that the outer profile is more important than the inner profile. In a preferred form however the inner profile is characterised by a second vector U, describing the location of any particular point on the inner profile and having its point of origin at said second location is such that as the magnitude of vector U increases, an angle between vector U and that tangent to said circumference which passes through said second location never decreases substantially and never becomes less than negative 0.52 radian at least for substantial magnitudes of vector U.

It has been found that with profiled inlets in accordance with this invention, it is not necessary to provide more than one inlet opening.

In another aspect, the invention provides a cyclone separator as first above described wherein an end wall of the separating chamber, through which said overflow outlet communicates with the separating chamber, is formed of curved configuration such as being concave or convex when viewed in axial section. Usually, angles $\theta$ and $\zeta$ never become less than zero.

In another aspect the invention provides a cyclone separator as first above described wherein the overflow outlet is in the form of a duct which extends through an end wall of the separating chamber and projects into the separating chamber.

The invention is further described by way of example only with reference to the accompanying drawings, in which.

Figure 1:
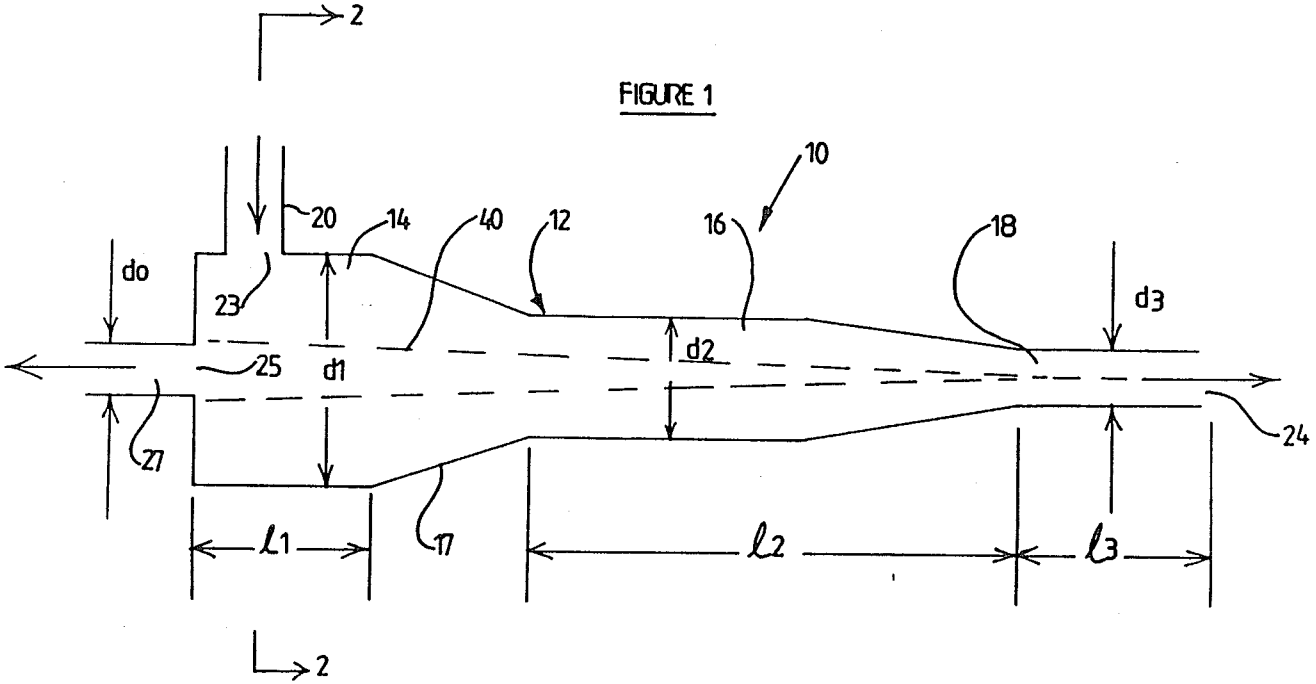
FIG. 1 is a cross-sectional diagram of a separator constructed in accordance with the invention.

The separator 10 comprises a separating chamber 12 having three coaxially arranged separating chamber portions 14, 16, 18 of cylindrical configuration. These are of diameters and lengths $d_1$, $l_1$; $d_2$, $l_2$; and $d_3$, $l_3$ respectively. Portion 14 is of greater diameter than portion 16 and portion 18 is of lesser diameter than portion 16. As described in the specification of Patent Application PCT/AU83/00028, a flow restricting means (not shown) may be provided at the outlet from the cylindrical portion 18 but in this instance the outlet end is shown as being provided by an underflow outlet 24 from cylindrical portion 18. A tapered section 17 may be provided between portions 14 and 16. Although the portion 16 shown exhibits a first section of parallel sided form followed by a tapered section, in practice, it is possible to form portion 16 as having a constant taper over its length.

Figure 2:
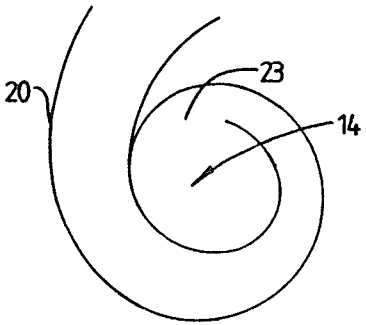
FIG. 2 is a cross-section substantially on the line 2—2 in FIG. 1.

An involute inlet pipe 20 is provided to the separating chamber portion 14, this opening into a side wall of the separating chamber at an inlet opening 23. An overflow outlet 25 is provided on the axis of the separating chamber portion 14, this leading to an axial overflow pipe 27. As shown in FIG. 2, the involute inlet pipe 20 spirals around the periphery of the separating chamber portion 14 and exhibits a gradually decreasing cross-sectional area as it approaches the opening 23. The pipe 20 and opening 23 may be of rectangular cross-section.

In use, the separator 10 functions generally in accordance with past practice in that the fluid mixture admitted into the separating chamber via the inlet pipe 20 is subjected to centrifugal action causing the separated liquid components to be ejected, on the one hand from the outlet 24 and on the other through the outlet 25. Thus, the denser phase material flows to the underflow outlet 24 in an annular cross-sectioned flow around the wall of the separating chamber whilst the lighter phase forms a central core 40 which is subjected to differential pressure action driving the fluid therein out the overflow outlet 25.

It has been found that using the involute shaped pipe 20, it is possible to use only a single opening 23, whereas in the past multiple inlet openings have been provided. These led to the disadvantage that, particularly where banks of separators are to be assembled together, the assembled installation is of relatively great complexity. Accordingly, by having only a single inlet pipe, the number of pipe connections that need to be made is decreased. Furthermore, it has been found that the involute shaped pipe 20 facilitates the separating action since incoming liquid mixture is already subjected to some separating action under centrifugal action as it spirals into the separating chamber 14.

The separating chamber 12 may be constructed somewhat in accordance with the teachings of Australian patent specification No. 47105/79 the disclosures of which are hereby incorporated into the present specification to form part thereof. In specification No. 47105/79, the separating chamber is described as having the following dimensional relationships:

$$10 \leqq l_2/d_2 \leqq 25$$

$$0.04 \leqq 4A_i/\pi d_1^2 \leqq 0.10$$

$$0.1 \leqq d_0/d_2 \leqq 0.25$$

$$d_1 > d_2$$

$$d_2 > d_3$$

where $A_1$ is the total cross-sectional area of the feed inlet, provided by inlet opening 23, $d_0$ is the diameter of the overflow outlet 25 and the remaining terms have the meanings ascribed to above.

Also, in the specification of Australian Patent Application No. 84713/82 a variant construction is described having parameters as above described save for the ratio $d_0/d_2$ which is specified in that case to be less than 0.1. Separators constructed in accordance with this variant form may also be adapted for use in the present invention. Generally, in any event the separator of this invention may advantageously be characterised by having the ratio $l_2/d_2$ at least equal to 10. Also, for separators intended for separating relatively small quantities of less dense liquid, such as oil, from relatively larger quantities of more dense liquid such as water, the ratio $d_1/d_2$ may be in the range 1.5 to 3.0, such as 2.0.

However, it has been found in practice that it is not necessary to adhere to the range of overflow outlet dimensions described above.

Figure 6:
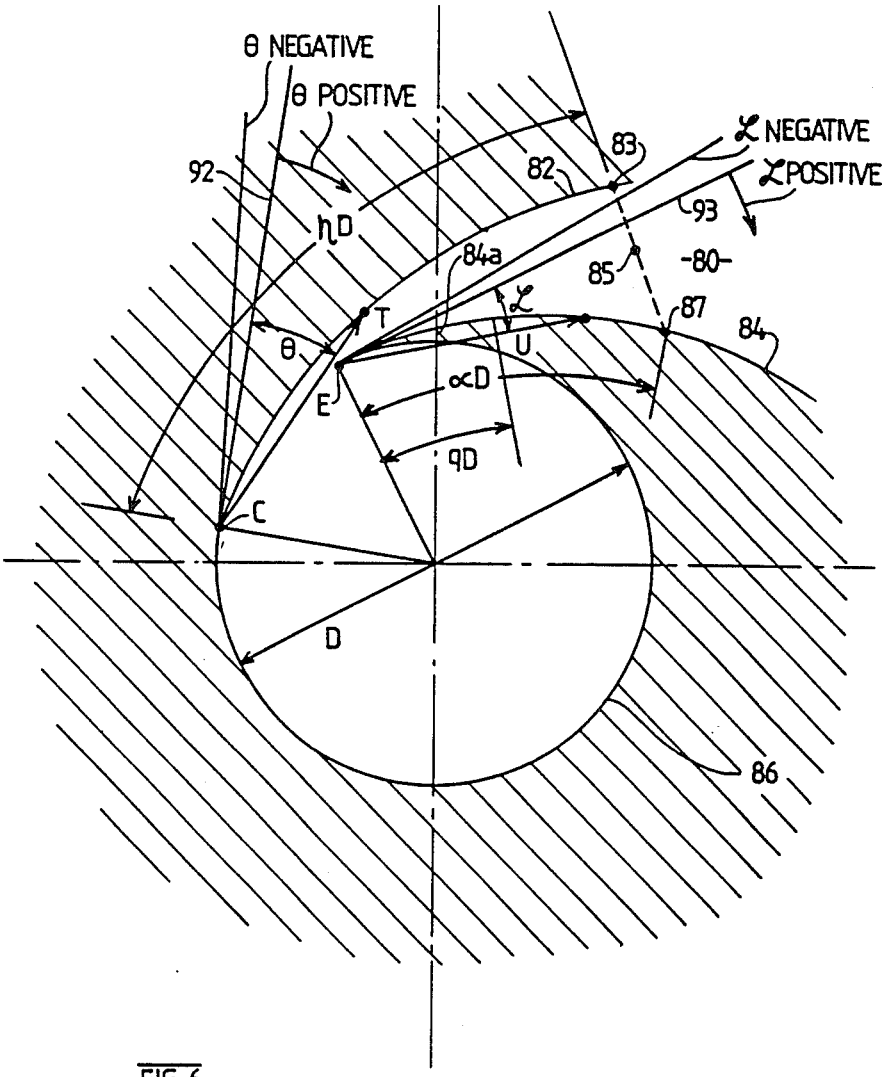
FIG. 6 is a detailed axial cross-sectional view of the inlet means of a separator constructed in accordance with the invention.

Referring now to FIG. 6 an inlet profile of the invention is shown in more detail. Here, the inlet means of the separator is shown as comprising an inlet tract 80 together with a portion of the separating chamber of the separator which is lengthwise adjacent thereto. In this regard, generally, although the separator shown in FIG. 1 is described as having three distinct portions of successively decreasing diameters, it is not essential that the separator be so formed as it could, for example, exhibit any generally tapered configuration extending from a larger diameter end adjacent the overflow outlet to a smaller cross-section end adjacent the underflow outlet. The tract 80 is shown as having an outer profile 82 and an inner profile 84. Here, the diameter D of the cyclone separator as shown in FIG. 6 corresponds to the diameter $d_1$ in FIG. 1, since the inlet tract 80 (as in the case of the FIG. 1 construction) communicates with the separating chamber at the larger diameter end thereof.

The tract 80 is considered as extending from a location indicated generally by reference numberal 85 inwardly towards the separating chamber. The location 85 is defined as a point beyond which, reckoned in the direction inwardly towards the separating chamber the flow of inlet liquid cannot be described by the simple flow equations. More particularly, the points 83, 87 on the outer and inner profiles aligned with location 85 are points where, if the profiles were projected outwardly therefrom in parallel relationship the separator would operate substantially the same as if the profiles were continued in the profiled configurations defined in accordance with this invention. By the term "outwardly projected" is meant a projection from the respective profile which is substantially tangential at the point of meeting the respective profile. From the respective points 83, 87 on the outer and inner profiles respectively the profiles extend in spiral fashion inwardly to meet the circumferential surface 86 of the separating chamber. Locations at which the profiles so meet circumference 86 are designated respectively by letters "C" and "E". Practically, although the profile 84 is shown as joining circumference 86 by continuance of the profile inwardly until it meets the circumference 86 at the point "E", for mechanical reasons it is frequently simpler and more effective to round the junction between the profile 84 and the circumference 86 by providing a rounded portion 84*a* (indicated by broken lines).

The inner and outer profiles preferably generally described by the following equations:

$$\alpha < \eta 2\pi + \alpha, \quad \text{(a)}$$

$$0.35 < \alpha < 1.5, \quad \text{(b)}$$

where $\eta D$ is the length of the outer profile 82 of the inlet tract, viewed axially of the separating chamber, D being the diameter of the portion of the separating chamber at which circumference 86 prevails. This profile length is that extending between points "C" and 83. $\alpha D$ is the length of the inner profile 84, viewed axially of the separating chamber. This profile length is that extending between points "E" and 87.

Generally, the outer profile 82 is such that vector T describing the location of any particular point on outer profile and contained in a plane normal to said axis, and having its origin at location "C", is such that as the magnitude of the vector T increases, an angle $\theta$ between the vector T and a tangent 92 to circumference 86 passing through said location "C" never decreases substantially and never becomes less than negative 0.1 radian for all magnitudes of T less than $D\eta$ Similarly, a vector U, describing the location of any particular point on the inner profile 84 and having its point of origin at location "E" is such that as the magnitude of vector U increases, the angle $\zeta$ between vector U and a tangent 93 to said circumference which passes through said location "E" never decreases substantially and never becomes less than negative 0.52 radian, for all magnitude of vector U less than $\alpha D$, at least for substantial magnitudes of vector U. By substantial magnitude of vector U, we mean that in the vicinity of the location "E", vector U may not be defined because of possible rounding of the inner profile as previously described.

The cross-sectional area $A_1$ of the tract 80 measured in a radial and axial plane passing through the location where the inner profile 84 actually terminates (location "E", or the extremity of the portion 84*a* as the case may be) is preferably defined as:

$$0.04<4A_i/\pi D^2<0.1$$

It is also preferred that the following relationship holds between the constants $\eta$ and $\alpha$ $$\alpha<\eta<2\pi+\alpha$$

The described relationship between the constants $\alpha$ and $\eta$ is most appropriate where, relatively speaking, the separator has a maximum diameter which is relatively more than the diameter of the underflow outlet. However where this ratio is relatively smaller, such as less than 3 it may be preferable to place greater restrictions on the relative values of the constants $\alpha$ and $\eta$. The following may then be appropriate:

$$D/d\leqq 3$$

$$\alpha<\eta<2\pi+\alpha,$$

and $$0.35<\alpha<2.$$

Here, d represents the underflow outlet diameter corresponding to diameter $d_3$ in FIG. 1.

Figure 7:
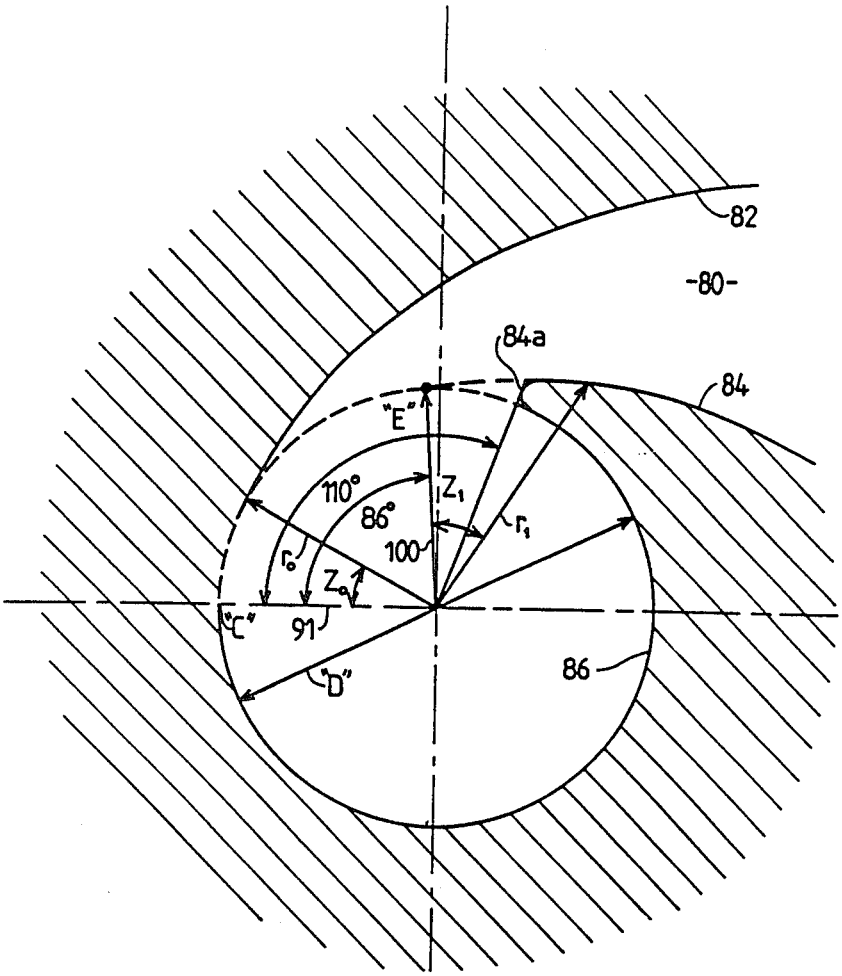
FIG. 7 is a diagram like FIG. 6 but showing preferred inlet tract profiles.

Referring now to FIG. 7, in one construction in accordance with the invention, the angle $\rho$ measured about the axis of the separator between the points "C" and "E" was 86°. The inner profile 84 was terminated by a curved portion 84*a* co-joining with circumference 86, this portion had a curvature of approximately 0.5 mm and located some 110° around the axis of the separator from the point "C". In this instance, it was found that the following mathematical relationship was appropriate for describing the profiles 82, 84:

$$r_0=0.5D+0.0143DZ_0^{1.4}+0.0057DZ_0^{1.8}+0.00157D\cdot Z_0^{2.8}+0.00286DZ_0^{4.5}$$

$$r_i=0.5D+0.0714DZ_i^2=0.00714DZ_i^3+0.0143\cdot DZ_i^4+0.00714DZ_i^5$$

where $r_0$ is the distance from the axis of the separator to any particular point on the outer profile 82, $r_i$ is the distance from the axis of the separator to any particular point on the inner profile 84, $Z_0$ is the angle, reckoned from the line 91 joining the axis of the separator and the point "C", in a clockwise direction around the axis of the separator to any point on the outer profile 82 and $Z_i$ is the angle, reckoned from the line 100 in a clockwise direction to any particular point on the inner profile 84.

These equations describing the profiles 82, 84 generally may prevail for angles $Z_0$, $Z_i$ in the range $$0°<Z_0<150°$$

$$0°<Z_i<60°$$

or at least in the range $$24°<Z_i<60°.$$

The tract 80 may have a rectangular transverse cross-section such as having longer sides extending parallel to the axis of the separator and of length W and shorter sides contained in planes normal to the axis of the separator and of length t. In this case the following relationships may prevail $$t\times W=A_i,$$

and $$D/35<t<D/6.$$

Generally, W will be greater than t.

Figure 8:
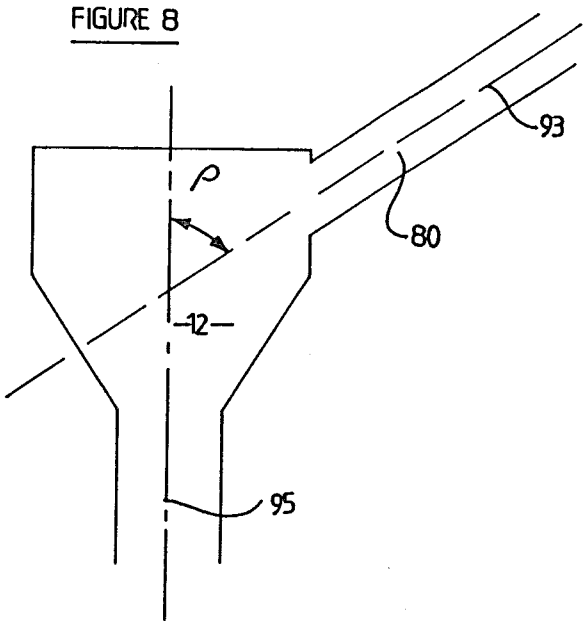
FIG. 8 is a fragmentary axial diagram of a modified inlet tract.

FIG. 8 shows a further modification of the separator in accordance with the invention where the inlet tract 80 is shown as extending with its mean flow path 93 for liquid flowing therein as being at an angle to the axis 95 of the separator rather than being normal thereto as illustrated in FIG. 1. In this case the axis 93 of tract 80 makes an angle to axis in the range $$80°<\rho<95°.$$

Where the tract is of rectangular cross-section it is preferred that it be of such rectangular cross-section at least over a length $q^D$ where q is less than $\alpha$.

In this specification, all angles are to be understood as being expressed in radians unless otherwise specified.

The described separator inlet configuration may readily be employed where more than one tract 80 is provided.

In this case, the total cross-sectional area of all the tracts measured radially of the separator through respective points "E" should equal the area $A_i$ such as where appearing in a formula $t\times W=A_i$ should be replaced by $A_i/n$ where n is the number of tracts 80. It should also be noted that not all of the tracts need be identical. In particular, where they are not identical the total area $A_i$ is related to the lengths and widths of the feed tracts at the relevant cross-sections as follows:

$$\Sigma t_n\times W_n=A_i,$$

where $t_n$ and $W_n$ are the width and length respectively of the $n^{th}$ tract.

The described separator has been found to provide excellent operating characteristics when separating smaller quantities of oil from larger quantities of water.

Figure 5:
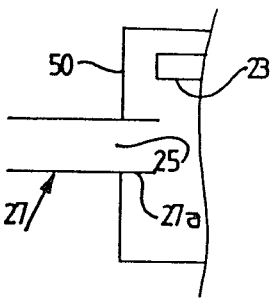
FIG. 5 shows an alternative form of the overflow outlet for the separator of FIG. 1.
Figure 4:
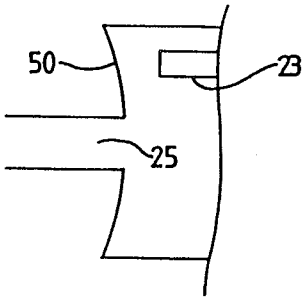
FIGS. 3 and 4 illustrate alternative forms of an end wall of the separating chamber of FIG. 1.
Figure 3:
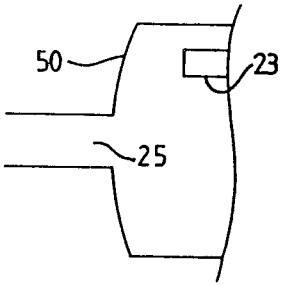

FIG. 3 shows a modification of the separator of FIG. 1. Here, the end wall 50 of the separating chamber portion 14, adjacent overflow outlet 25, is formed of concave form. In FIG. 4, the end wall 50 is shown in a further modification as exhibiting a convex form when viewed in axial section. FIG. 5 shows a still further modification where the overflow inlet 25 is formed from a pipe 27 having a portion 27*a* which extends through wall 50 (in this case, shown as being linear in axial section) and into the separating chamber 14 a short distance.

While forming the inlet means of the separator with the described configurations permits only a single inlet to be employed, the described configurations may be advantageously employed even where more than one inlet is provided.

The term "involute" is used in this specification to describe a curve being the locus of the end of a piece of string uncoiled from a base circle. The inner and outer profiles of the or each inlet tract as described are generally formed as involute curves. Each profile may however, have cojoining sections defined by cojoining involute curves having respective defining base circles of differing diameters, or the projected start points on the respective base circles may be relatively circumferentially spaced.

The described arrangement has been advanced merely by way of explanation and many modifications may be made thereto without departing from the spirit and scope of the invention as defined in the appended claims.

I claim:

1. A cyclone separator for separating denser components of a fluid mixture from less dense components thereof, said separator comprising: means for permitting provision of only a single inlet opening in an axially extending separating chamber having towards one end inlet means for admission of the mixture with a tangential flow component, the separating chamber having an axially positioned overflow outlet adjacent said one end and said separating chamber of generally tapered form with a relatively larger cross-sectional size at said one end and a relatively small cross-sectional size at an axially positioned underflow outlet at the end of the separating chamber opposite said one end, including means for directing the denser component to the underflow outlet in a fashion such as to encompass an inner axially positioned core of the less dense component which is subjected at least over a substantial part of its length to a pressure differential causing it to flow to the overflow outlet, said inlet means being defined by a portion of the separating chamber and at least one inlet tract communicating with said portion, said portion being that portion of the separating chamber which is at the same lengthwise position as the or each inlet tract, wherein the or each inlet tract includes means for presenting inner and outer profiles, when viewed axially of the separator, said outer profile extending from a first location at which it meets the circumference of said portion of the separating chamber and at least the inward projection of said inner profile extending from a second location at which the inner profile or its said projection meets said circumference, said outer profile being dimensioned so that a first vector T describing the location of any particular point on said outer profile and contained in a plane normal to said axis, and having its origin at said first location, is such that as the magnitude of the vector T increases, an angle $\theta$ between the vector T and that tangent to said circumference which passes through said first location never decreases substantially and never becomes less than negative 0.1 radian; the cross-sectional area perpendicular to the direction of flow generally contracting in the direction of flow.

2. A cyclone separator according to claim 1 the inner profile being characterised by a second vector U, describing the location of any particular point on the inner profile and having its point of origin at said second location is such that as the magnitude of vector U increases, an angle $\zeta$ between vector U and that tangent to said circumference which passes through said location never decreases substantially and never becomes less than negative 0.52 radian, at least for substantial magnitudes of vector U.

3. A cyclone separator as claimed in claim 2 wherein said inlet means is characterised in that as said magnitude of said first vector T increases said angle $\theta$ never decreases substantially and never becomes less than negative 0.1 radian for all magnitudes of vector T less than $\eta D$, and that as said second vector U increases, said angle $\zeta$ never decreases substantially and never becomes less than negative 0.52 radian for at all magnitudes of vector U less than $\alpha D$, at least for substantial magnitudes of vector U, where $$\alpha<\eta<2\pi+\alpha, \quad \text{(c)}$$

$$0.35<\alpha<1.5, \quad \text{(d)}$$

where $\eta D$ being the length of the outer profile of the inlet tract, viewed axially of the separating chamber, D being the diameter of said portion of the separating chamber $\alpha D$ being the length of the inner profile of the inlet tract viewed axially of the separating chamber, $\eta D$ being measured from a first location at which the outer profile meets the circumference of its portion of the separating chamber and $\alpha D$ being measured from a second location at which at least an inward projection of the inner profile meets said circumference.

4. A cyclone separator as claimed in claim 3 wherein:

$$0.04<4A_i/\pi D^2<0.1 \quad \text{(e)}$$

where $A_i$ is the cross-sectional area of said tract, or the combined cross-sectional area of all said tracts, if there are more than one tract, the or each cross-sectional area being measured in a plane substantially perpendicular to tract inlet flow and intersecting the point of termination of said inner profile.

5. A cyclone separator as claimed in claim 4 characterised in that $$\alpha<\eta<2\pi+<. \quad \text{(f)}$$

6. A cyclone separator as claimed in claim 5 wherein the or each tract is of rectangular cross-section over at least a length qD for $q\alpha$, the cross-section over at least a length $W_n$ and a width $t_n$ where $$\Sigma t_n \times W_n = A_i, \quad \text{(g)}$$

and $$D/35<t<D/6 \quad \text{(h)}$$

where $w_n$ is the length of the cross-section of the $n^{th}$ tract and $t_n$ is the width of the $n^{th}$ tract.

7. A cyclone separator as claimed in claim 4 wherein the or each tract is of rectangular cross-section over at least a length qD for $q\alpha$, the cross-section over at least a length $W_n$ and a width $t_n$ where $$\Sigma t_n \times w_n = A_i, \quad \text{(g)}$$

and $$D/35<t<D/6 \quad \text{(h)}$$

where $W_n$ is the length of the cross-section of the $n^{th}$ tract and $t_n$ is the width of the $n^{th}$ tract.

8. A cyclone separator as claimed in claim 7 wherein the sides of the or each cross-section of length W are aligned generally in the axial direction of the separator and those of width t are aligned generally normally to the axis of the separator.

9. A cyclone separator as claimed in claim 8 where $W>t$.

10. A cyclone separator as claimed in claim 3 wherein $D/d>3$, where d is the diameter of said underflow outlet.

11. A cyclone separator as claimed in claim 3 wherein $$D/d \leqq 3$$

$$\alpha<\eta<2\pi+\alpha,$$

and $$0.35<\alpha<2.$$

12. A cyclone separator as claimed in claim 1 wherein the or each tract extends at a respective angle to the axis of the separator, when viewed normally of said axis, wherein the respective angle $\rho$ between said axis and the mean inlet flow direction for liquid mixture when admitted through a respective inlet tract, at the point where the mean flow path intersects the said respective tract cross-section at which the area $A_i$ is measured, is $$80°<\rho<95° \quad \text{(j)}$$

where the angle $\rho$ is defined such that for values thereof less than 90° the liquid flow into the separating chamber in use, along said flow path, has a motional component which is directed in the direction from the larger diameter to the smaller diameter end of the separating chamber.

13. A cyclone separator as claimed in claim 1 wherein said angle $\theta$ is characterized in that, as said vector T increases, it never becomes less than zero.

14. A cyclone separator as claimed in claim 1 wherein the inner profile is characterized in that a second vector U, describing the location of any particular point on the inner profile and having its point of origin at said second location is such that as the magnitude of vector U increases, an angle $\zeta$ between vector U and that tangent to said circumference which passes through said second location never decreases and never becomes less thant zero, at least for substantial magnitudes of vector U.

15. A cyclone separator as claimed in claim 1 wherein the or each inlet tract is of substantially involute form.

16. A cyclone separator as claimed in claim 1 wherein the or each inlet tract has an outer profile of substantially involute form.

17. A cyclone separator for separating denser components of a fluid mixture from less dense components thereof, said separator comprising: means for permitting provision of only a single inlet opening in an axially extending separating chamber having towards one end inlet means for admission of the mixture with a tangential flow component, the separating chamber having an axially positioned overflow outlet adjacent said one end and said separating chamber of generally tapered form with a relatively larger cross-sectional size at said one end and a relatively small cross-sectional size at an axially positioned underflow outlet at the end of the separating chamber opposite said one end, including means for directing the denser component to the underflow outlet in a fashion such as to encompass an inner axially positioned core of the less dense component which is subjected at least over a substantial part of its length to a pressure differential causing it to flow to the overflow outlet, said inlet means being defined by a portion of the separating chamber and at least one inlet tract communicating with said portion, said portion being that portion of the separating chamber which is at the same lengthwise position as the or each inlet tract, wherein the or each inlet tract includes means for presenting inner and outer profiles, when viewed axially of the separator, said outer profile extending from a first location at which it meets the circumference of said portion of the separating chamber and at least the inward projection of said inner profile extending from a second location at which the inner profile or its said projection meets said circumference, said outer profile being dimensioned so that a first vector T describing the location of any particular point on said outer profile and contained in a plane normal to said axis, and having its origin at said first location, is such that as the magnitude of the vector T increases, an angle $\theta$ between the vector T and that tangent to said circumference which passes through said first location is in the range less than 0 to negative 0.1 radian; the cross-sectional area perpendicular to the direction of flow generally contracting in the direction of flow.

18. A cyclone separator according to claim 17 the inner profile being characterised by a second vector U, describing the location of any particular point on the inner profile and having its point of origin at said second location is such that as the magnitude of vector U increases, an angle $\zeta$ between vector U and that tangent to said circumference which passes through said location is in the range less than 0 to negative 0.52 radian.

19. A cyclone separator for separating denser components of a fluid mixture from less dense components thereof, said separator comprising: means for permitting provision of only a single inlet opening in an axially extending separating chamber having towards one end inlet means for admission of the mixture with a tangential flow component, the separating chamber having an axially positioned overflow outlet adjacent said one end and said separating chamber of generally tapered form with a relatively larger cross-sectional size at said one end and a relatively small cross-sectional size at an axially positioned underflow outlet at the end of the separating chamber opposite said one end, including means for directing the denser component to the underflow outlet in a fashion such as to encompass an inner axially positioned core of the less dense component which is subjected at least over a substantial part of its length to a pressure differential causing it to flow to the overflow outlet, said inlet means being defined by a portion of the separating chamber and at least one inlet tract communicating with said portion, said portion being that portion of the separating chamber which is at the same lengthwise position as the or each inlet tract, and the or each said tract being of substantially involute form.

20. A cyclone separator for separating denser component(s) of a fluid mixture from less dense component(s) thereof said separator comprising: means for permitting provision of only a single inlet opening in an axially extending separating chamber having towards one end inlet means for admission of the mixture with a tangential flow component, the separating chamber having an axially positioned overflow outlet adjacent said one end and said separating chamber of generally tapered form with a relatively larger cross-sectional size at said one end and a relatively small cross-sectional size at an axially positioned underflow outlet at the end of the separating chamber opposite said one end, including means for directing the denser component to the underflow outlet in a fashion such as to encompass an inner axially positioned core of the less dense component which is subjected at least over a substantial part of its length to a pressure differential causing it to flow to the overflow outlet, wherein an end wall of the separating chamber, through which said overflow outlet communicates with the separating chamber, is formed of curved configuration.

21. A cyclone separator as claimed in claim 20 wherein said end wall is at least partially concave.

22. A cyclone separator as claimed in claim 20 wherein said end wall is at least partially convex.

23. A cyclone separator for separating denser components of a fluid mixture from less dense components thereof, said separator comprising: means for permitting provision of only a single inlet opening in an axially extending separating chamber having towards one end inlet means for admission of the mixture with a tangential flow component, the separating chamber having an axially positioned overflow outlet adjacent said one end and said separating chamber of generally tapered form with a relatively larger cross-sectional size at said one end and a relatively small cross-sectional size at an axially positioned underflow outlet at the end of the separating chamber opposite said one end, including means for directing the denser component to the underflow outlet in a fashion such as to encompass an inner axially positioned core of the less dense component which is subjected at least over a substantial part of its length to a pressure differential causing it to flow to the overflow outlet, wherein the overflow outlet is in the form of a duct which extends through an end wall of the separating chamber and projects into the separating chamber.

24. A cyclone separator as claimed in claim 1 having only one said inlet tract.

25. A cyclone separator as claimed in claim 17 having only one said inlet tract.

* * * * *

UNITED STATES PATENT AND TRADEMARK OFFICE

CERTIFICATE OF CORRECTION

PATENT NO. : 4,710,299

DATED : December 1, 1987

INVENTOR(S) : GAVAN J.J. PRENDERGAST

It is certified that error appears in the above-identified patent and that said Letters Patent are hereby corrected as shown below:

Front Page, left-hand column, under Foreign Application Priority Data, change:

Jan. 24, 1985 [CA] Canada ...472531 to ---Jan. 22, 1985 [CA] Canada ...472531---.

Signed and Sealed this

Sixth Day of September, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,710,299

DATED : December 1, 1987

INVENTOR(S) : GAVAN J.J. PRENDERGAST

It is certified that error appears in the above-identified patent and that said Letters Patent are hereby corrected as shown below: On The Title Page:

Front Page, left-hand column, under Related U.S. Application Data

"PCT AU85/0001" should read ——PCT AU85/00010 ---.

Signed and Sealed this

First Day of November, 1988

*Attest:*

*Attesting Officer*

DONALD J. QUIGG

*Commissioner of Patents and Trademarks*